United States Patent [19]

Roethel et al.

[11] Patent Number: 4,887,742

[45] Date of Patent: Dec. 19, 1989

[54] ONE PIECE DISPENSING VALVE

[75] Inventors: Henry G. Roethel; James P. Leigh, both of Ravenna, Ohio

[73] Assignee: The Meyer Company, Cleveland, Ohio

[21] Appl. No.: 209,550

[22] Filed: Jun. 21, 1988

[51] Int. Cl.[4] ..... B67B 5/00

[52] U.S. Cl. ..... 222/153; 222/542; 222/544; 215/235

[58] Field of Search ..... 222/543, 556, 544, 153, 222/542, 511, 563; 215/235, 237, 100 R

[56] References Cited

U.S. PATENT DOCUMENTS

| | | | |
|---|---|---|---|
| 2,021,731 | 11/1935 | Leins | 222/511 |
| 2,851,203 | 9/1958 | Nowak | 222/543 |
| 3,195,573 | 7/1965 | Daumy | 137/625.4 |
| 3,400,866 | 9/1968 | Fattori | 222/511 |
| 3,416,567 | 12/1968 | Von Dardel et al. | 137/853 |
| 3,434,695 | 3/1969 | Green | 251/349 |
| 3,443,728 | 5/1969 | Scholle | 222/511 |
| 3,690,344 | 9/1972 | Braumm | 137/625.28 |
| 4,275,765 | 6/1981 | Dugas | 137/625.48 |
| 4,621,750 | 11/1986 | Roethel | 222/505 |

FOREIGN PATENT DOCUMENTS

| | | | |
|---|---|---|---|
| 471466 | 12/1950 | Italy | 222/543 |
| 574158 | 3/1958 | Italy | 222/543 |
| 782639 | 7/1955 | United Kingdom | 222/543 |

*Primary Examiner*—Joseph J. Rolla
*Assistant Examiner*—Kenneth Noland
*Attorney, Agent, or Firm*—Fay, Sharpe, Beall, Fagan, Minnich & McKee

[57] ABSTRACT

Dispensing valves particularly intended for use on bag-in-the-box type beverage containers comprise a molded one piece structure formed of a resinous plastic material. The structure includes a body defining a fluid passageway having an inlet end and an outlet end. The body also includes a first wall member having an orifice through which the outlet end of the fluid passageway opens. The first wall member defines a first surface extending laterally outwardly of the orifice. A second wall member is molded integrally with the first wall member from a resilient material capable of undergoing significant elastic deformation. The second wall member sealingly overlies the orifice and is joined to the first wall at locations laterally outwardly of the orifice throughout a major circumferential extent. Operating device is provided for selectively deflecting the second wall member away from the orifice to permit flow through the orifice and between the first and second wall members.

8 Claims, 2 Drawing Sheets

ONE PIECE DISPENSING VALVE

BACKGROUND OF THE INVENTION

The subject invention is directed toward the valve art and, more particularly, to an improved dispensing valve assembly. The invention is especially suited for use as a disposable dispensing valve for bag-in-the-box type beverage containers and will be described with particular reference thereto; however, as will be appreciated, the invention is capable of broader application and could be used in a variety of environments for valving many different types of fluids.

An extremely large variety of designs have been proposed for use as dispensing valves. Dispensing valves for use in bag-in-the-box type beverage containers face special problems. First, the valves must be extremely inexpensive since they are generally disposed of with the container upon the completion of use of the beverage. In addition, the valves must be capable of operating throughout a wide range of temperatures and providing a sure, drip-free closure throughout a large number of cycles. Although as noted, a large number of different valves have been proposed for such use, few if any have been able to satisfy all the design criteria.

The subject invention provides an extremely simple and easy to fabricate valve design which is inexpensive and capable of providing a secure, drip-free shut-off.

BRIEF SUMMARY OF THE INVENTION

Specifically, in accordance with one aspect of the invention, the valve comprises a body which defines a fluid passage terminating in an outlet orifice. A first wall member is integral with the body and defines a first surface which extends laterally outwardly about the orifice. A second wall member formed from a resilient material capable of undergoing significant elastic deformation is positioned to overlie the orifice and has a peripheral portion joined to the first wall member throughout a circumferential extent sufficient to cause the second wall member to sealingly engage about the orifice. Additionally, operating means are provided for selectively deflecting the wall member away from the orifice to permit flow from the passage to pass out through the orifice and between the first and second wall members.

Preferably, and in accordance with a further aspect of the invention, the first and second and wall members are formed as an integral one-piece molding and the second wall member is deflected into position over the orifice in the first wall member and sealed about a portion of its outer periphery to the first wall member at a location spaced outwardly of the orifice.

A still further aspect of the invention contemplates that the orifice is carried on a tubular member which protrudes from the surface of the first wall member, and, wherein the second wall member is tensioned over the tubular member prior to being joined along its peripheral edges to the first surface of the wall member.

The valves formed in accordance with the invention can be quickly and inexpensively manufactured as a single injection molded component. The first and second walls, as well as the main body, can be molded from the same resinous plastic material and the required lateral joining of the second wall member to the first wall member can be accomplished through many different types of bonding or mechanical connection processes.

In accordance with a more limited aspect of the invention the operating means comprises a handle member joined to the second wall member. The handle member can also be molded as a integral portion of the second wall member.

As is apparent from the foregoing, a primary object of the invention is the provision of a dispensing valve which is formed from a single, unitary molding.

A still further object of the invention is the provision of a dispensing valve of the type described which is capable of producing drip-free shut-off.

A still further object is the provision of a dispensing valve of the type described which is extremely simple in design and construction and which is capable of multiple cycles of operation.

BRIEF DESCRIPTION OF THE DRAWINGS

The above and other objects and advantages will become apparent from the following description and read in conjunction with the accompanying drawings wherein:

Referring more particularly to the drawings wherein the showings are for the purpose of illustrating a preferred embodiment of the invention only, and not for the purpose of limiting same, FIGS. 1 and 2 show the overall arrangement of a dispensing valve assembly 10 formed in accordance with the preferred embodiment of the invention. The valve assembly 10 generally includes a somewhat cylindrical main body portion 12 provided with means for permitting connection to an associated beverage container not shown. In this embodiment the connecting means comprise an internal opening 14 sized for receipt of the typical outlet nozzle of a bag-in-the-box type beverage container. Specifically, the recess 14 has a tapered or chamfered outer peripheral surface 16 which connects through a cylindrical portion 18 with a flange receiving groove 20. Located generally at the center of the right hand side of body 12 (as viewed in FIG. 2) is a tubular portion 22 which defines a flow passage 24 which connects with an outlet orifice 26.

Figure 1:
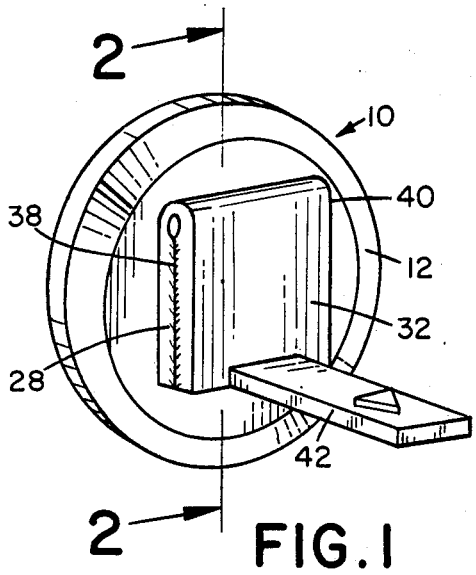
FIG. 1 is a pictorial view of a preferred embodiment of the subject invention.
Figure 4:
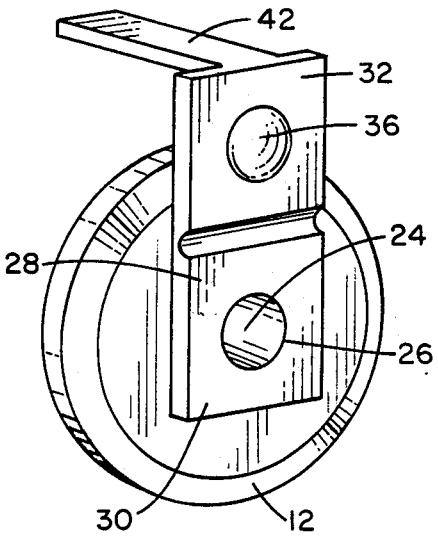
FIG. 4 is a pictorial view showing the valve forming component in its "as-molded" condition.

Carried at the right hand end of the tubular portion 22 is a first wall member 28. As shown, wall member 28 is generally planar and has a first surface 30 which lies substantially coplanar with the outlet orifice 26. As best seen in FIGS. 1 and 4, the wall member 28 is illustrated as having a generally rectangular configuration and the orifice 26 is located generally centrally thereof. Integrally connected with the first wall 28 is a second wall member 32. Wall member 32 has a generally rectangular outer size generally corresponding to the shape and configuration of the first wall member 28. As illustrated, the wall member 32 is originally molded so that it is integral with and directly connects to the upper end of wall member 28 as shown in FIG. 4. Preferably, a central protrusion 36 is formed on the surface of wall portion 32 centrally of the wall.

Figure 2:
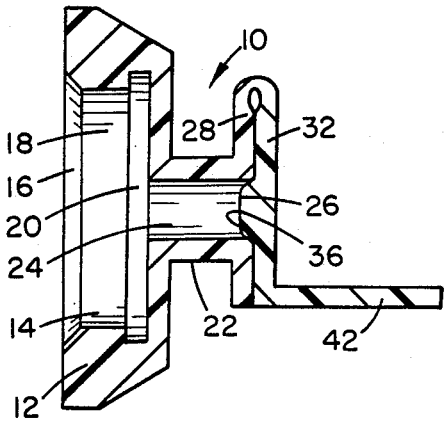
FIG. 2 is a cross-sectional view taken on line 2—2 of FIG. 1.

As best illustrated in FIGS. 1 and 2, the central portion 36 is arranged and sized so that when the wall member 32 is folded into overlying relationship on the surface 30 of the first wall member 38, the protrusion 36 enters into the orifice 26 in the manner of a valve plug, as shown. With the second wall member 32 in the position shown in FIG. 2, the lateral side edges (see FIG. 1) 38 and 40 are joined to the corresponding lateral side edges of the wall portion 28. This joining can be through heat sealing, use of a suitable adhesive or even mechanical connectors. With the wall member 32 joined to the wall portion 28 in the manner described, the protrusion 36 enters the orifice 28 to provide a fluid tight seal. To open the orifice 26 and permit flow to take place, the outer wall member 32 is resiliently deflected away from the inner wall member 28 to withdraw the protrusion 36 from the orifice 26. For this purpose an operating means in the form of a handle member 42 is joined to the outer or second wall member 32. Preferably, the handle member 42 is molded integrally with wall member 32; however, separate handles of other designs could equally well be used.

Figure 3:
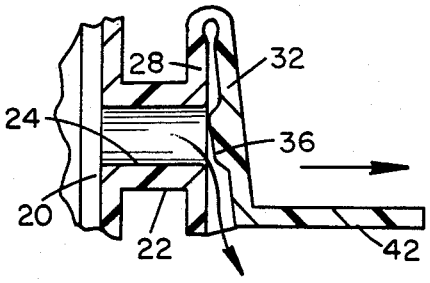
FIG. 3 is a partial cross-sectional view similar to FIG. 2 but showing the valve in an open position.

As best shown in FIG. 3, when an outwardly directed pulling force is applied to the handle 42, the wall member 32 is deflected away from the inner wall member 28 in the manner shown. This permits fluid to flow from the interior of the associated beverage bag (not shown) through the passageway 24 and passed through the orifice 26 to a position between the walls 28 and 32 to discharge from the valve as shown by the arrow. Release of the handle 42 causes the wall 32 to resiliently return to the closed portion illustrated in FIG. 2.

FIG. 4 illustrates the preferred "as-molded" form of the valve. The valve can be molded in this form from a single type of suitable resinous plastic material such as silicon rubber, latex, and certain vinyl plastics. Because only a single molding of simple design is required, the valve is relatively inexpensive and easy to form.

Figure 5:
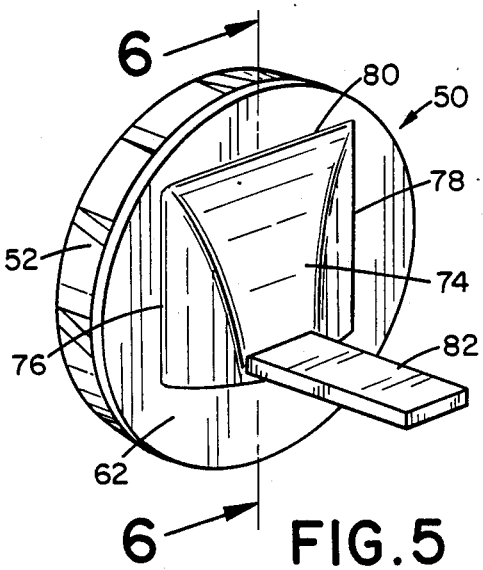
FIG. 5 is pictorial view of a second embodiment of a dispensing valve formed in accordance with the invention.
Figure 6:
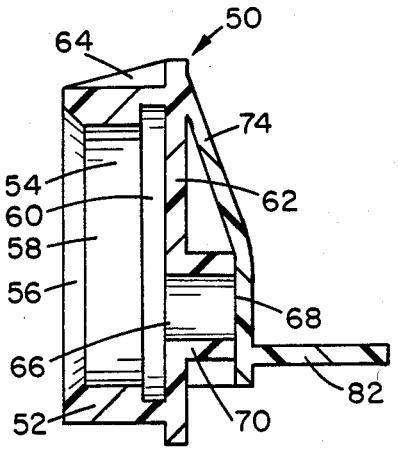
FIG. 6 is a cross-sectional view taken on line 6—6 of FIG. 5 and showing the valve in a closed position.

FIGS. 5 through 8 illustrate a second embodiment of a valve formed in accordance with the subject invention. Referring in particular to FIGS. 5 and 6, the valve is indicated generally with the reference number 50 and includes a generally cylindrical main body section 52. The body section 52 defines an opening or cavity 54 which extends into the body to define a means for connecting the valve to the suitable bag-in-the-box outlet nozzle or the like as described with reference to the prior embodiment. As shown, the opening 54 includes a tapered portion 56, a central cylindrical section 58 and a flange receiving groove 60. The arrangement allows the main body 52 to be resiliently received on and retained on the bag-in-the-box outlet nozzle (not shown). The right hand side of the main body 52 (as viewed in FIGS. 5 and 6) includes a generally circular first wall member 62. The wall member 62 extends radially outward beyond the main cylindrical extent of first body portion 52 and a plurality of reinforcing sections 64 are shown as extending between the peripheral edge of the wall 62 and the outer surface of body 52.

A flow passage 66 extends through the wall member 62 and terminates in an outlet orifice 68. Passage 66 is carried on a tubular portion 70 which extends outwardly beyond the right hand face of the wall member 62.

Figure 7:
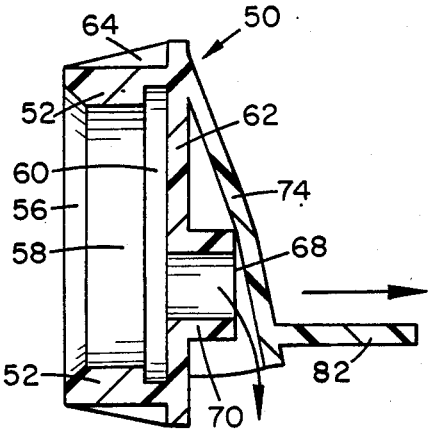
FIG. 7 is a view similar to FIG. 6 but showing the valve in an open or dispensing position; and, FIG. 8 is a cross-sectional view showing the FIG. 5 embodiment of its "as-molded" condition.

Overlying the wall member 62 and the orifice 68 is a second wall member 74. Wall member 74 is, as best shown in FIG. 5, joined to the first wall member 62 along its lateral side edges 76 and 78 as well as along its top edge 80. The second wall member 74 is joined in the manner so as to sealingly engage about the orifice 68 and, as shown in FIG. 6, prevent flow therethrough. Like the FIGS. 1 through 4 embodiment, however, a lateral deflection of the wall 74 allows flow to pass through the orifice 68 as shown in FIG. 7. In order to allow the second wall 74 to be readily deflected it is provided with an operating means in the form a handle tab 82 which is molded integrally with the wall 74.

Figure 8:
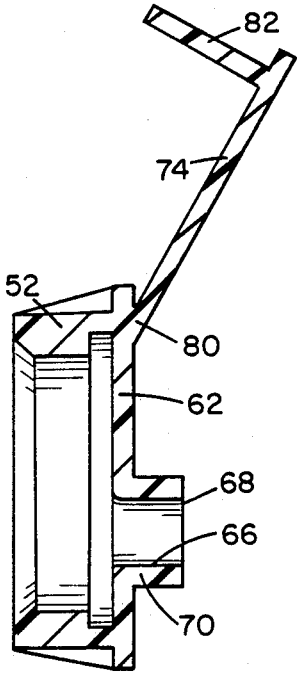

FIG. 8 illustrates the valve 50 in its as molded condition. As illustrated, the second wall portion or member 74 is integral with the first wall portion along the upper edge portion 80. During manufacture, the wall 74 is moved to the FIG. 6 position and bonded such as by heat sealing or by an adhesive applied along edges 76 and 78 to the wall 62. Preferably joining takes place with the wall 74 under substantial tension so that a tight sealing engagement is achieved with the orifice 68.

As is apparent from the foregoing, the subject invention provides an extremely simple and highly reliable dispensing valve assembly. Obviously, modifications and alterations of the preferred embodiments will occur to others upon a reading and understanding of the specification and it is intended to include all such modifications and alterations as part of the invention insofar as they come within the scope of the appended claims.

What is claimed is:

1. A valve comprising:

a body defining a fluid passageway having an inlet end and an outlet end;

said body including a first wall member having an orifice through which said outlet end of said fluid passageway opens; said first wall member defining a first surface extending laterally outwardly of said orifice;

a second wall member having first and second laterally spaced edge portions and a third edge portion connected therebetween, said second wall member formed from a resilient material capable of undergoing significant elastic deformation, said second wall member positioned to overlie said orifice and having said first and second laterally spaced edge portions joined to said first wall at locations laterally outwardly of said orifice throughout a major circumferential extent to thereby cause said second wall member to sealingly engage about said orifice; and, operating means for selectively deflecting said third edge portion of said second wall member away from said orifice to permit flow through said orifice and between said first and second wall members and past said third edge portion.

2. The valve of claim 1 wherein said second wall member includes a portion which enters said orifice and sealingly engages the periphery of said orifice.

3. The valve of claim 1 wherein said orifice is located coplanar with said first surface.

4. The valve of claim 1 wherein said first wall member and said second wall member are molded as a unitary integral component.

5. The valve of claim 1 wherein said orifice is located at the end of a tubular member extending outwardly from said first wall member.

6. The valve as defined in claim 1 wherein said second wall member is formed from the same material as said first wall member.

7. The valve as defined in claim 6 wherein said first and second wall members are molded as unitary, integral components joined along a flexible web portion.

8. The valve as defined in claim 7 wherein said operating means comprises a handle member joined to said second wall member.

* * * * *